US006857465B2

(12) United States Patent
Watzinger et al.

(10) Patent No.: US 6,857,465 B2
(45) Date of Patent: Feb. 22, 2005

(54) METHOD FOR THE PRODUCTION OF A CONTINOUSLY-CAST PRECURSOR

(75) Inventors: Josef Watzinger, Reichenau (AT); Markus Brummayer, Aschach (AT); Philipp Gittler, Leonding (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 0 days.

(21) Appl. No.: 10/297,285

(22) PCT Filed: Mar. 23, 2001

(86) PCT No.: PCT/EP01/03304

§ 371 (c)(1),
(2), (4) Date: Apr. 25, 2003

(87) PCT Pub. No.: WO01/91951

PCT Pub. Date: Dec. 6, 2001

(65) Prior Publication Data

US 2003/0159796 A1 Aug. 28, 2003

(30) Foreign Application Priority Data

May 31, 2000 (AT) ..... 956/2000

(51) Int. Cl.[7] ..... B22D 11/10

(52) U.S. Cl. ..... 164/489; 164/437; 222/606; 222/591

(58) Field of Search ..... 164/489, 437; 222/606, 591

(56) References Cited

U.S. PATENT DOCUMENTS 4,858,794 A * 8/1989 Sugiura et al. ..... 222/606

6,626,229 B2 * 9/2003 Urlau et al. ..... 164/488

FOREIGN PATENT DOCUMENTS

| | | |
|---|---|---|
| DE | 19647363 | 5/1998 |
| DE | 19724232 C2 | 12/1998 |
| DE | 19724232 A1 | 12/1998 |
| EP | 0352346 | 1/1990 |
| JP | 01245951 | 10/1989 |

* cited by examiner

*Primary Examiner*—Tom Dunn
*Assistant Examiner*—I.-H. Lin
(74) *Attorney, Agent, or Firm*—Ostrolenk, Faber, Gerb & Soffen, LLP

(57) ABSTRACT

A process for producing a continuous-casting plant for producing these products and a submerged nozzle therefor and a continuously cast primary product, in particular broad slabs, having a thickness of the primary product D>100 mm and a width of the primary product B=2700 mm to 3500 mm at a casting rate $v_c$<2 m/min in a continuous-casting plant. To achieve uniform solidification conditions for the cast strand and uniform melting and distribution conditions for the casting powder, molten material leaves the submerged nozzle through opposite outlet openings with a momentum which is directed toward the narrow side walls a mold, and for a defined width:thickness ratio of the primary product, as a function of the ratio of the velocity of the molten material in the core cross section of the submerged nozzle ($v_k$) to the casting rate ($v_c$), design values for the width (b) of the submerged nozzle and the height (h) of the lateral outlet opening of the submerged nozzle are selected in such a way that a uniform strand shell is formed in the casting direction and peripheral direction along the wide side walls and narrow side walls of the permanent mold.

15 Claims, 2 Drawing Sheets

METHOD FOR THE PRODUCTION OF A CONTINOUSLY-CAST PRECURSOR

CROSS-REFERENCE TO RELATED APPLICATION

This application is a 371 of PCT/EP01/03304 filed on Mar. 23, 2001.

BACKGROUND OF THE INVENTION

The invention relates to a process for producing a continuously cast primary product, in particular broad slabs, having a thickness of the primary product D>100 mm and a width of the primary product B=2700 mm to 3500 mm at a casting rate $v_c$<2 m/min in a continuous-casting plant. In the process molten material, preferably molten steel, from a reservoir is introduced via a submerged nozzle into a permanent mold, which is formed by wide side walls and narrow side walls. The primary product has partially solidified in the permanent mold and has a liquid core and a solidified strand shell. It is continuously withdrawn from the permanent mold and cooled. The invention also relates to a continuous-casting plant for producing a continuously cast primary product and to a submerged nozzle for use in this continuous-casting plant.

When the submerged-casting process is used in continuous casting, it is customary for the molten material to be introduced from a reservoir, generally a tundish, through a submerged nozzle which is coupled thereto, into an oscillating permanent mold below a bath level which is covered with casting powder. This procedure can be carried out without problems for small permanent-mold cross sections, but, in particular with permanent molds with a high width-:thickness ratio, leads to difficulties with the formation of an optimum permanent-mold flow and therefore impairs uniform strand shell growth during the gradual solidification of the molten material at the cooled permanent-mold wall.

DE-C 197 24 232 has already disclosed a process for producing primary products in the form of slabs in a continuous-casting plant using the principle described above. In this case, the molten material is introduced into the permanent mold through a submerged nozzle which lies below the bath level, is open at the bottom in the casting direction and widens out in the shape of a funnel toward the narrow side walls of the permanent mold. If the dimension rule given in claim 2 of DE-C 197 24 232 for the submerged nozzle in terms of its width (b) is applied to the widths (B) of the primary product or of the permanent mold of from 2700 mm to 3500 mm which are provided for according to the invention, the result is submerged nozzle widths (b) of approximately 385 mm to 2250 mm, which cannot be produced from refractory materials with the durability when used at high temperatures which is required for long-term operation. Moreover, such wide submerged nozzles exacerbate the known problems with the gap flow between submerged-nozzle wall and wide side wall of the permanent mold.

DE-C 196 47 363 has disclosed a submerged nozzle which is suitable for use for the continuous casting of slabs and in which the molten material emerges below the bath level through outlet openings, which lie laterally opposite one another, toward the narrow side walls of the permanent mold. An essential feature of this submerged nozzle is the constant distance between its outer wall and the strand shell which is formed along the wide side wall. This means that this submerged nozzle is suitable for a width:thickness ratio of the cast strand or of the permanent-mold cross section of at most 8. However, if the width:thickness ratios are higher, this submerged nozzle cannot ensure a permanent-mold flow which creates uniform solidification conditions.

During the continuous casting of primary products with high widths, despite standard casting rates of 1.0 m/min to 1.2 m/min, very high steel throughputs of up to 4 to/min and above are reached. In practice, it has been found with these high steel throughputs that the swirl-forming flows which form in the permanent mold are very unstable. The guidance property of the permanent-mold chamber for this flow deteriorates at increasing distance between the submerged nozzle outlet opening and the narrow side wall. In addition, the emerging jet, on account of its high local flow velocity in the submerged nozzle and immediately after it emerges from the submerged-nozzle outlet opening, on account of the resistance of the molten material and the high wall friction along the permanent mold walls, is greatly decelerated and, on account of the reduced pressure between casting level and emerging jet, is diverted upward toward the casting level. A fluctuating, oscillating bath movement, which has an adverse effect on the product quality, is visually observed.

This unfavorable formation of the flow conditions is illustrated in FIG. 1 on the basis of a filament of flow. In the region between the submerged nozzle and the permanent-mold narrow side wall, the emerging jet hits the bath surface, where it splits into two partial jets. This phenomenon leads to a lack of uniformity in the melting of the casting powder at the bath surface and to local adverse effects on the sliding characteristic between stand and permanent-mold wall. When conventional submerged nozzles are used to cast broad slabs, it is difficult for the above-mentioned reasons, to produce a favorable and stable flow in the permanent mold.

SUMMARY OF THE INVENTION

Therefore, it is an object of the invention to avoid these drawbacks which have been described and to propose a process for producing a continuously cast primary product, as well as the continuous-casting plant required for this process and a submerged nozzle for use in this continuous-casting plant, in which uniform solidification conditions for the strand and uniform melting and distribution conditions for the casting powder are ensured even for high cast widths. Furthermore, by means of a defined supply of steel through the submerged nozzle, it is intended to produce a stable system of swirling in the permanent mold which is formed by two large, round swirls directed upward. Furthermore, it is an object of the invention not to allow any lateral deflection of the emerging jet, and in particular to prevent the emerging jet from coming into contact with the bath level prematurely.

According to the invention, this object is achieved by a process which is characterized in that the molten material of the primary product leaves the submerged nozzle through opposite outlet openings of the nozzle with a momentum which is directed toward the narrow side walls of the permanent mold, and for a defined width:thickness ratio of the primary product, as a function of the ratio of the velocity of the molten material in the core cross section of the submerged nozzle ($v_k$) to the casting rate ($v_c$). Design values for the width (b) of the submerged nozzle and the height (h) of the lateral outlet openings of the submerged nozzle are selected in such a way that a uniform strand shell is formed in the casting direction and peripheral direction along the wide side walls and narrow side walls of the permanent mold.

Optimum conditions for the formation of the strand shell are established if the submerged nozzle in relation to the permanent mold satisfies the following conditions $$\frac{h}{B} = \frac{9}{5}\psi + \frac{1}{5}\frac{D}{B}$$

and $$\frac{b}{h} = 1.9 - 2.0$$

and a numerical ratio ψ, which sets the relationship of the velocity of the molten material in the core cross section of the submerged nozzle ($v_k$) to the casting rate ($v_c$), is determined according to the following condition $$\psi = 0.1\left(\frac{B}{D}\right)^{-0.7}$$

in which:

B=width of the primary product (mm)

D=thickness of the primary product (mm)

b=width of the submerged nozzle (mm)

h=height of the lateral outlet opening of the submerged nozzle (mm)

ψ=numerical ratio (no dimensions).

For the width:thickness ratios selected, the above condition results in ψ values of from 0.011 to 0.015. These values express the fact that for optimum flow conditions low flow velocities in the submerged nozzle are required, and according to the invention are achieved by means of large core and outlet cross sections at the submerged nozzle. The reduction in the flow velocity avoids considerable lateral deviations of the emerging jet which are caused by the reduced pressure between the emerging jet and the casting level.

These measures make it possible to form a stable swirling system with large, substantially round swirls which turn upward, as illustrated diagrammatically in FIG. 2 for the half of the permanent-mold chamber which lies to the left of the submerged nozzle on the basis of a filament of flow. The swirl diameter approximately corresponds to half the strand width. The jet-outlet angle of approximately 40 to 45° required for this purpose is achieved by means of the great height (h) of the lateral outlet opening of the submerged nozzle. As a result, the known phenomenon whereby the emerging jet is diverted toward the casting level after only a short distance when there is considerable flow diversion in the submerged nozzle (small outlet angle) is reduced. The great height (h) of the lateral outlet opening means that a flow which is subject to little or no rotation is established.

Furthermore, the measures of the invention ensure that it is possible to build up a system with very pronounced swirls. For this purpose, the emerging jet which leaves the submerged nozzle must not be decelerated excessively between the two permanent-mold wide sides. The decelerating action on the emerging jet is determined by wall friction, which forms through contact between the moving emerging jet and the strand shell. Since the decelerating frictional force increases to approximately the power of two with respect to the flow velocity, the outlet velocity is according to the invention kept at a low level.

An advantageous application range for the process is provided if the primary product has a width:thickness ratio $$\frac{B}{D} = 15 - 25,$$

preferably a width:thickness ratio $$\frac{B}{D}$$

of approximately 20.

For the proposed primary product cross sections, it is preferable for the casting rate $v_c$ to be set to between 0.5 m/min and 1.5 m/min.

A continuous-casting plant according to the invention for the production of a continuously cast primary product, in particular of broad slabs, having a thickness of the primary product D>100 mm and a width of the primary product B=2700 mm to 3500 mm at a casting rate of $v_c$<2 m/min, comprising a permanent mold, which is formed by wide side walls and narrow side walls, a submerged nozzle which projects into the permanent mold on the entry side and a reservoir for the molten material, and also devices which are arranged on the exit side of the permanent mold for withdrawing, guiding and cooling the primary product, which has partially solidified in the permanent mold and has a liquid core and a solidified strand shell is characterized in that the submerged nozzle includes outlet openings which lie opposite one another and in the operating position are directed toward the narrow side walls of the permanent mold, in that the internal dimensions of the permanent mold at the level of the lateral outlet openings of the submerged nozzle substantially correspond to the dimensions of the primary product, and in that the width (b) of the submerged nozzle and the height (h) of the lateral outlet opening of the submerged nozzle are fixed in relation to a defined width: thickness ratio of the primary product or the permanent mold in such a way that the conditions $$\frac{h}{B} = \frac{9}{5}\psi + \frac{1}{5}\frac{D}{B}$$

and $$\frac{b}{h} = 1.9 - 2.0$$

are fulfilled and a numerical ratio ψ which sets the relationship between the velocity of the molten material in the core cross section of the submerged nozzle ($v_k$) to the casting rate ($v_c$) is determined according to the following condition $$\psi = 0.1\left(\frac{B}{D}\right)^{-0.7}.$$

A continuous-casting plant of this type is particularly suitable if the primary product has a width:thickness ratio $$\frac{B}{D} = 15 - 25,$$

preferably a width:thickness ratio $$\frac{B}{D}$$

of approximately 20.

To achieve an optimum jet outlet angle, the inner base of the submerged nozzle is designed to be inclined from the center of the submerged nozzle toward the outlet opening in the casting direction. Particularly favorable conditions are established if the inclination of the inner base of the submerged nozzle is from 10° to 20°, preferably approximately 15°.

A submerged nozzle according to the invention for use in a continuous-casting plant for producing a continuously cast primary product, in particular broad slabs, having a thickness of the primary product D>100 mm and a width of the primary product B=2700 mm to 3500 mm at a casting rate of $v_c$<2 m/min, this continuous-casting plant having a permanent mold, which is formed by wide side walls and narrow side walls and into which the submerged nozzle projects in operation is characterized in that the submerged nozzle has lateral outlet openings which lie opposite one another, and a continuous inner base, in that the internal dimensions of the permanent mold at the level of the lateral outlet openings of the submerged nozzle substantially correspond to the dimensions of the primary product, in that the width (b) of the submerged nozzle and the height (h) of the lateral outlet opening of the submerged nozzle are fixed in relation to a defined width:thickness ratio of the primary product or the permanent mold in such a way that the following conditions $$\frac{h}{B} = \frac{9}{5}\psi + \frac{1}{5}\frac{D}{B}$$

and $$\frac{b}{h} = 1.9 - 2.0$$

are fulfilled and a numerical ratio ψ which sets the relationship of the velocity of the molten material in the core cross section of the submerged nozzle ($v_k$) to the casting rate ($v_c$) is determined according to the following condition $$\psi = 0.1\left(\frac{B}{D}\right)^{-0.7}.$$

An advantageous configuration is provided by the inner base of the submerged nozzle being designed to be inclined from the center of the inner base toward the outlet opening. The inclination of the inner base of the submerged nozzle is 10° to 20°, preferably approximately 15°. This significantly increases the tendency to form a turbulence-free emerging jet. Only two outlet openings, which are of substantially rectangular design, are arranged at the submerged nozzle.

BRIEF DESCRIPTION OF THE DRAWINGS

Further advantages and features of the present invention will emerge from the following description of two nonlimiting exemplary embodiments, in which reference is made to the following figures, in which.

DESCRIPTION OF THE PREFERRED EMBODIMENT

Steel continuous-casting plants for the production of broad slabs are generally known, are described in the literature and substantially comprise a tundish for holding the molten steel, from which the molten material is transferred via a submerged nozzle into an oscillating permanent mold. A partially solidified cast strand of steel is conveyed vertically downward out of the permanent mold, is cooled in a subsequent strand-guidance section and is then diverted into a horizontal orientation. Then, the fully solidified cast strand is divided into slabs by means of a flame-cutting machine, and the slabs are then fed for further treatment.

Figure 3A:
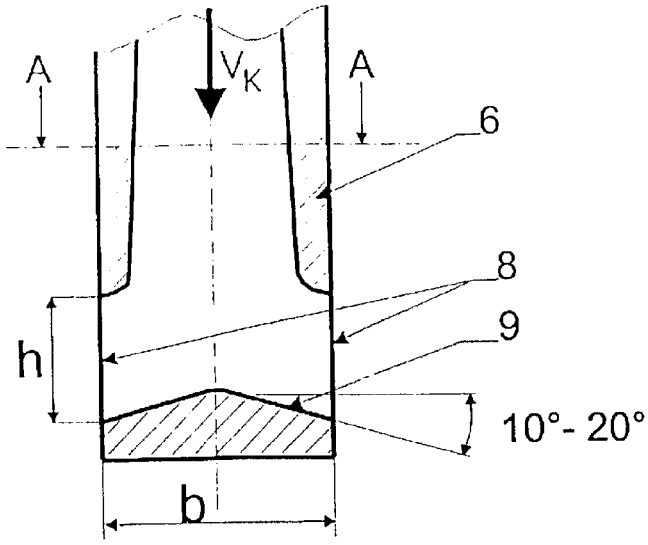
FIG. 3*a* shows part of a longitudinal section through the submerged nozzle according to the invention.
Figure 3B:
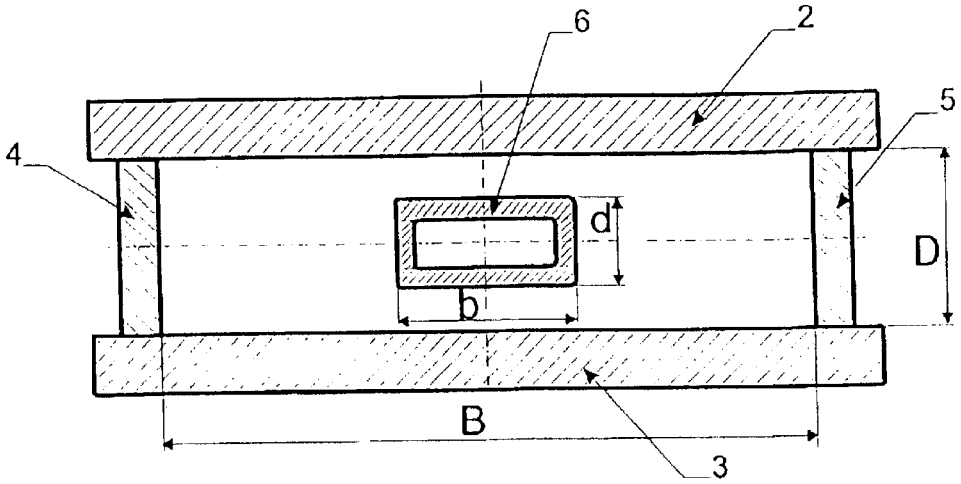
FIG. 3*b* shows the diagrammatic outline of permanent mold and submerged nozzle on section A—A through the submerged nozzle shown in FIG. 3*a*.

The shaping of the cast strand takes place in an oscillating continuous-casting permanent mold 1 which, as diagrammatically depicted in FIG. 3*b*, is formed by wide side walls 2, 3, which lie opposite one another, and narrow side walls 4, 5, which can be clamped between the wide side walls, it being possible for the narrow side walls 4, 5 to be displaced transversely to the casting direction in order to set different strand widths (B). The inner surfaces of these walls form a chamber which determines the format for the formation of a partially solidified cast strand which is discharged from the permanent mold as primary product.

The invention is restricted to a process for producing a primary product with a width B of from 2700 to 3500 mm and a thickness D>100 mm and to a continuous-casting plant having a permanent mold which has these cross-sectional dimensions. In the permanent mold itself, the cast strand is not subject to any significant deformation.

The molten material which is to be cast is introduced from a reservoir which is not shown but is well known in casting plants of this type, via a submerged nozzle 6 below the bath level 7 formed by the molten material in the permanent mold, through lateral outlet openings 8 directed toward the narrow side walls 4, 5, into the continuous-casting permanent mold 1. The molten material flows through the submerged nozzle 6 in the vertical direction, which corresponds to the casting direction in the permanent mold, at the velocity $v_k$ and, in the region of the continuous inner base 9 of the submerged nozzle 6, is diverted toward the lateral outlet openings 8 and passes through them into the permanent-mold chamber. The inner base 9 is designed to be inclined from its center toward the outlet opening 8 in the casting direction. This inclination and the height (h) of the lateral outlet opening (8) determine the direction (the angle) of the emerging molten material and therefore influence the flow which is formed. The submerged-nozzle thickness (d) is substantially determined by the thickness of the primary product (D). The width (B) and the thickness (D) of the primary product are fixed by production specifications. The result of this is that the width (b) of the submerged nozzle, the height (h) of the lateral outlet opening of the submerged nozzle and the dimensionless number ψ, which substantially describes the ratio of casting rate $v_c$ and velocity $v_k$ of the liquid jet in the submerged nozzle (core cross section), can be selected as desired.

The value ψ in relation to the submerged nozzle geometry determines the velocity of the molten material in the submerged-nozzle outlet cross section and is therefore crucial to the quality of the permanent-mold flow. When casting medium-thick and wide slabs (width:thickness ratio of approximately 20), ψ values of 0.006 to 0.008 are achieved with conventional submerged nozzles. Tests have shown that to cast very wide cast strands with the same width:thickness ratio, it is necessary to reach ψ values of 0.011 to 0.015. This requires lower velocities in the submerged nozzle, which are achieved by means of large core and outlet cross sections.

Table 1 below illustrates these relationships for a primary product thickness D=157 mm which is selected by way of example, with primary product widths of B=2500 mm and B=3000 mm. The submerged nozzles according to the invention are distinguished by the greater height h of the lateral outlet openings 8.

TABLE 1

| | conventional submerged nozzle | inventive submerged nozzle |
|---|---|---|
| B = 2500 mm | ψ = 0.006–0.008 | ψ = 0.011–0.015 |
| $\frac{D}{B} = 0.628$ | $\frac{h}{B} = 0.023 - 0.026$ | $\frac{h}{B} = 0.032 - 0.040$ |
| $\frac{B}{D} = 16$ | h = 58–67 mm | h = 81–99 mm |
| B = 3000 mm | ψ = 0.006–0.008 | ψ = 0.011–0.015 |
| $\frac{D}{B} = 0.052$ | $\frac{h}{B} = 0.021 - 0.025$ | $\frac{h}{B} = 0.030 - 0.037$ |
| $\frac{B}{D} = 20$ | h = 63–75 m | h = 91–112 mm |

Figure 1:
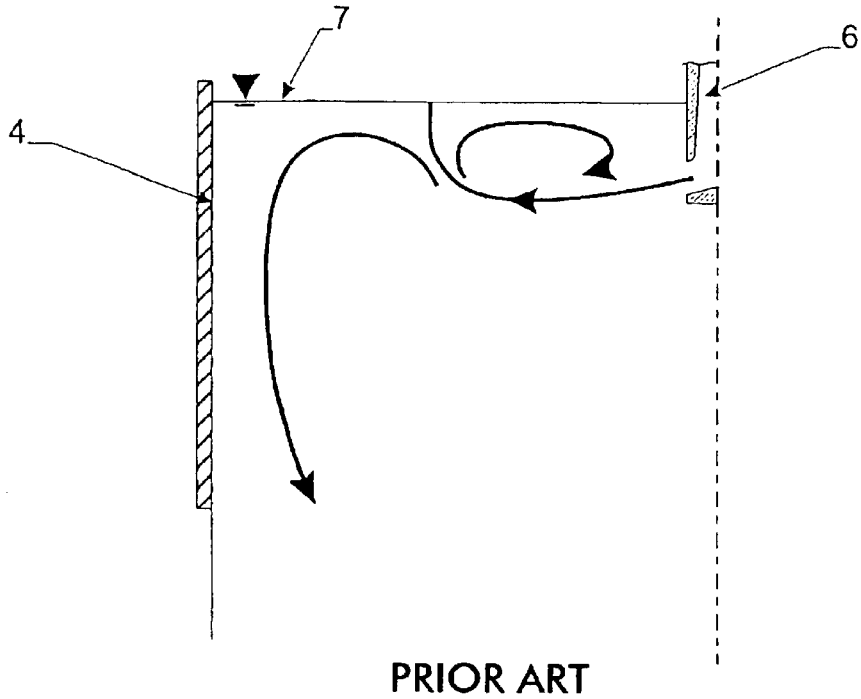
FIG. 1 diagrammatically depicts the permanent-mold flow when using a submerged nozzle in the permanent mold of a continuous-casting plant according to the prior art, FIG. 2 diagrammatically depicts the permanent-mold flow when using a submerged nozzle in the permanent mold of a continuous-casting plant according to the invention.
Figure 2:
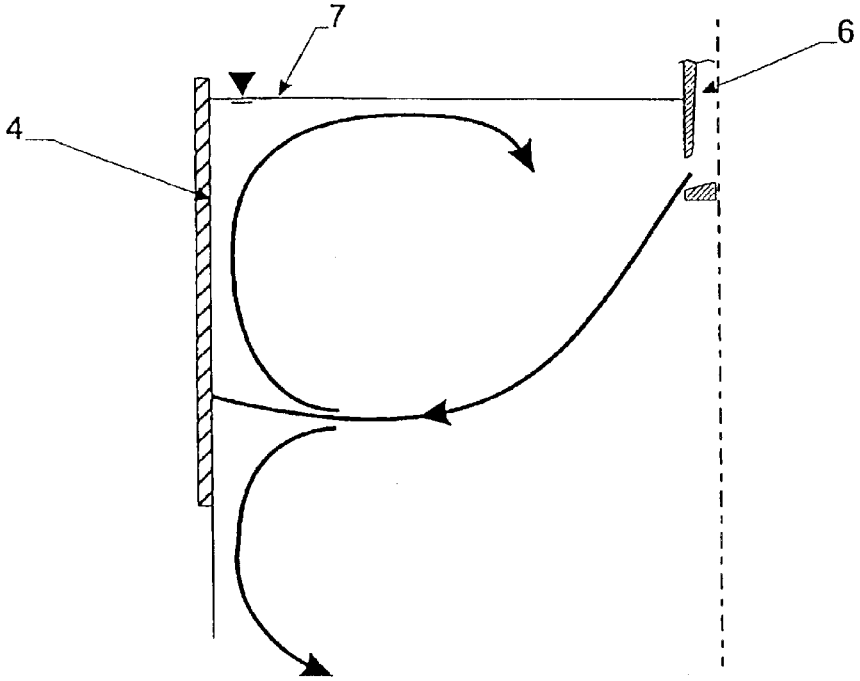

FIG. 1 diagrammatically depicts the formation of the permanent-mold flow on the basis of a filament of flow when using a conventional submerged nozzle, the emerging jet coming into contact with the bath surface in the region between submerged nozzle 6 and permanent-mold narrow side wall 4 and there being divided into two partial jets. By contrast, FIG. 2 shows the flow profile using a submerged nozzle according to the invention, in which the flow is only divided into two partial streams in the region of the narrow side wall 4 and forms two approximately circular swirls.

What is claimed is:

1. A process for producing a continuously cast primary product, having a thickness of the primary product D>100 mm and a width of the primary product B=2700 mm to 3500 mm at a casting rate $v_c$<2 m/min in a continuous-casting plant, comprising: introducing molten material of the primary product via a submerged nozzle into a mold, wherein the mold is formed with opposite wide side walls and opposite narrow side walls, allowing the primary product to partially solidify in the mold to have a liquid core and a solidified strand shell, continuously withdrawing the primary product from the permanent mold and permitting it to cool, causing the molten material of the primary product to leave the submerged nozzle through opposite outlet openings with a momentum which is directed toward the narrow side walls of the mold, and for causing a defined width: thickness ratio of the primary product, as a function of the ratio of the velocity of the molten material in the core cross section of the submerged nozzle ($v_k$) to the casting rate ($v_c$), by selecting design values for the width (b) of the submerged nozzle and the height (h) of the lateral outlet opening of the submerged nozzle such that a uniform strand shell is formed in the casting direction and peripheral direction along the wide side walls and narrow side walls of the mold and wherein the submerged nozzle in relation to the mold satisfies the following conditions $$\frac{h}{B} = \frac{9}{5}\psi + \frac{1}{5}\frac{D}{B}$$

and $$\frac{b}{h} = 1.9 - 2.0$$

and a numerical ratio ψ, which sets the relationship of the velocity of the molten material in the core cross section of the submerged nozzle ($v_k$) to the casting rate ($v_c$), is determined according to the following condition $$\psi = 0.1\left(\frac{B}{D}\right)^{-0.7}$$

in which:

B=width of the primary product (mm)

D=thickness of the primary product (mm)

b=width of the submerged nozzle (mm)

h=height of the lateral outlet opening of the submerged nozzle (mm)

ψ=numerical ratio (no dimensions).

2. The process as claimed in claim 1, wherein the primary product has a width:thickness ratio $$\frac{B}{D} = 15 - 25.$$

3. The process as claimed in claim 1, wherein the primary product has a width:thickness ratio $$\frac{B}{D}$$

of approximately 20.

4. The process as claimed in claim 1, wherein the casting rate $v_c$ is set to between 0.5 m/min and 1.5 m/min.

5. A continuous-casting plant for producing a continuously cast primary product having a thickness of the primary product D>100 mm and a width of the primary product B=2700 mm to 3500 mm at a casting rate of $v_c$<2 m/min, the plant comprising a mold which is comprised of opposite wide side walls and opposite narrow side walls; a submerged nozzle which projects into the mold on an entry side of the mold for receiving molten material, and also devices which are arranged on an exit side of the permanent mold for withdrawing, guiding and cooling the primary product, which has partially solidified in the mold and has a liquid core and a solidified strand shell, the submerged nozzle includes outlet openings which lie opposite one another and in the operating position are directed toward the narrow side walls of the mold, in that the internal dimensions of the mold at the level of the lateral outlet openings of the submerged nozzle substantially correspond to the dimensions of the primary product, and in that the width (b) of the submerged nozzle and the height (h) of the lateral outlet opening of the submerged nozzle are fixed in relation to a defined width: thickness ratio of the primary product or the permanent mold in such a way that the following conditions $$\frac{h}{B} = \frac{9}{5}\psi + \frac{1}{5}\frac{D}{B}$$

and $$\frac{b}{h} = 1.9 - 2.0$$

are fulfilled and a numerical ratio ψ which sets the relationship between the velocity of the molten material in the core cross section of the submerged nozzle ($v_k$) to the casting rate ($v_c$) is determined according to the following condition $$\psi = 0.1\left(\frac{B}{D}\right)^{-0.7}$$

in which:

B=width of the primary product or of the permanent mold (mm)

D=thickness of the primary product or of the permanent mold (mm)

b=width of the submerged nozzle (mm)

h=height of the lateral outlet opening of the submerged nozzle (mm)

ψ=numerical ratio (no dimensions).

6. The continuous-casting plant as claimed in claim 5, wherein the primary product or the mold has a width:thickness ratio $$\frac{B}{D} = 15 - 25.$$

7. The continuous-casting plant as claimed in claim 5, wherein the primary product or the mold has a width:thickness ratio $$\frac{B}{D}$$

of approximately 20.

8. The continuous-casting plant as claimed in claim 5, wherein the submerged nozzle has an inner base inclined from the center of the submerged nozzle toward the outlet opening in the casting direction.

9. The continuous-casting plant as claimed in claim 8, wherein the inclination of the inner base of the submerged nozzle approximately 15°.

10. The continuous-casting plant as claimed in claim 8, wherein the inclination of the inner base of the submerged nozzle is from 10° to 20°.

11. A submerged nozzle for use in a continuous-casting plant for producing a continuously cast primary product having a thickness of the primary product D>100 mm and a width of the primary product B=2700 mm to 3500 mm at a casting rate of $v_c$<2 m/min, wherein the continuous-casting plant has a mold, which is formed by wide side walls and narrow side walls and into which mold the submerged nozzle projects in operation, the submerged nozzle having lateral outlet openings which lie opposite one another, and has a continuous inner base, in that the internal dimensions of the permanent mold at the level of the lateral outlet openings of the submerged nozzle substantially correspond to the dimensions of the primary product, in that the width (b) of the submerged nozzle and the height (h) of the lateral outlet opening of the submerged nozzle are fixed in relation to a defined width:thickness ratio of the primary product or the permanent mold in such a way that the following conditions $$\frac{h}{B} = \frac{9}{5}\psi + \frac{1}{5}\frac{D}{B}$$

and $$\frac{b}{h} = 1.9 - 2.0$$

are fulfilled and a numerical ratio ψ which sets the relationship of the velocity of the molten material in the core cross section of the submerged nozzle ($v_k$) to the casting rate ($v_c$) is determined according to the following condition $$\psi = 0.1\left(\frac{B}{D}\right)^{-0.7}$$

in which:

B=width of the primary product or of the mold (mm)

D=thickness of the primary product or of the mold (mm)

b=width of the submerged nozzle (mm)

h=height of the lateral outlet opening of the submerged nozzle (mm)

ψ=numerical ratio (no dimensions).

12. The submerged nozzle as claimed in claim 11, wherein the inner base of the submerged nozzle is inclined from the center of the inner base toward the outlet opening.

13. The submerged nozzle as claimed in claim 12, wherein the inclination of the inner base of the submerged nozzle is 10° to 20°.

14. The submerged nozzle as claimed in claim 12, wherein the inclination of the inner base of the submerged nozzle is preferably approximately 15°.

15. The submerged nozzle as claimed in claim 11, wherein there are only two outlet openings which are of substantially rectangular design.

* * * * *